United States Patent [19]

Saint Georges Chaumet

[11] Patent Number: 4,995,751

[45] Date of Patent: Feb. 26, 1991

[54] DEVICE FOR APPLYING A LIQUID OR SEMI-PASTE SUBSTANCE ON A SURFACE

[76] Inventor: Bertrand Saint Georges Chaumet, 41 Avenue du Chesnay, 78170 La Celle Saint Cloud, France

[21] Appl. No.: 263,184

[22] Filed: Oct. 27, 1988

[30] Foreign Application Priority Data

Nov. 6, 1987 [FR] France ..... 87 15439

[51] Int. Cl.[5] ..... B43K 5/14

[52] U.S. Cl. ..... 401/135; 401/132

[58] Field of Search ..... 401/132–135, 401/184, 187, 188 R, 188 A, 190, 185

[56] References Cited

U.S. PATENT DOCUMENTS

| | | | |
|---|---|---|---|
| 1,935,000 | 11/1933 | Vessey | 401/135 |
| 2,333,451 | 11/1943 | Sussman et al. | 401/186 |
| 2,438,786 | 3/1948 | Moore . | |
| 2,787,249 | 4/1957 | Barlow et al. | 401/184 |
| 3,337,124 | 8/1967 | De Molin et al. . | |
| 3,819,285 | 6/1974 | Andrews et al. | 401/212 X |
| 4,124,316 | 11/1978 | O'Rourke | 401/184 |
| 4,712,937 | 12/1987 | Schmidt et al. | 401/213 |

FOREIGN PATENT DOCUMENTS

| | | | |
|---|---|---|---|
| 154091 | 11/1951 | Australia | 401/132 |
| 49271 | 2/1939 | France | 401/187 |
| 1041438 | 10/1953 | France . | |
| 1104868 | 11/1955 | France . | |
| 2298444 | 1/1979 | France . | |
| 2460163 | 2/1982 | France . | |
| 2494604 | 5/1982 | France . | |
| 2001285 | 1/1979 | United Kingdom . | |
| 2097007 | 10/1982 | United Kingdom | 401/220 |

*Primary Examiner*—Richard J. Apley
*Assistant Examiner*—D. F. Crosby
*Attorney, Agent, or Firm*—Young & Thompson

[57] ABSTRACT

The device for applying a liquid or semi-paste substance is provided with a hermetically sealed refill (1) containing said substance and removably disposed within a body (5), a head (7) for the application of the substance being removably fixed at one end of the body. A conical tube (9) is provided for putting the application head (7) into communication with the interior of the refill (1) and the other end of the body (5) is provided with a closure end-cap (12).

The refill (1) is closed at the end opposite to the application head (7) by a capsule (4) of perforatable material and the closure end-cap (12) carries a hollow needle (22, 29) which is capable of perforating said capsule (4, 26) when the refill is placed within the body (5). The hollow needle (22) communicates with air-pressurization means (17) consisting of a thumb-actuated hemispherical cap carried by the closure end-cap (12).

7 Claims, 2 Drawing Sheets

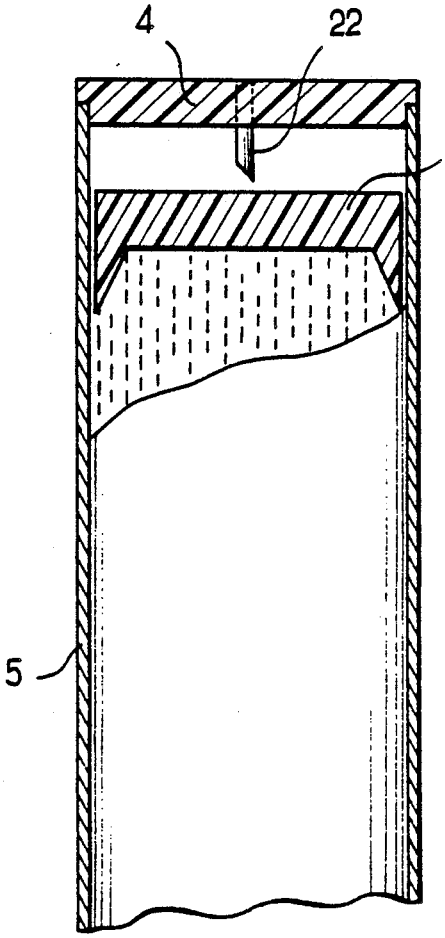
FIG. 3
FIG. 4
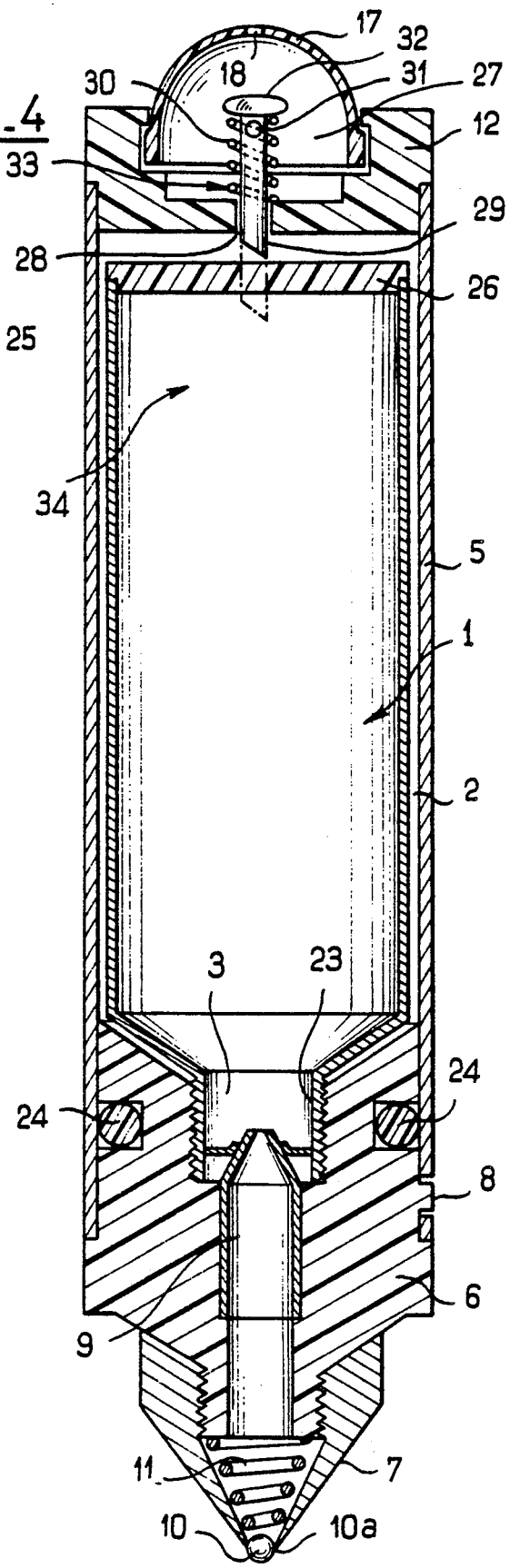

DEVICE FOR APPLYING A LIQUID OR SEMI-PASTE SUBSTANCE ON A SURFACE

BACKGROUND OF THE INVENTION

1. Field of the Invention

The present invention relates to a device for applying on a surface a liquid or semi-paste substance such as an ink or a paint containing volatile solvents.

The invention relates in particular to an industrial pen for writing on any surface and in which the ink refills are specially designed to receive fast-drying inks and therefore inks containing volatile solvents.

The device contemplated by the invention is mainly intended to mark various objects and especially metal parts, irrespective of the state of surface of such objects.

In other applications of the device which forms the subject of the invention, the ink can be replaced by any other liquid or pastelike product and said device is in that case a device for the application of said substance.

2. Description of the Prior Art

It is known that, in industry, certain marking operations have to be performed with an ink (usually opaque and viscous) which dries very rapidly.

This type of ink contains highly volatile solvents. It is therefore necessary up to the time of use to keep this ink in an absolutely air-tight envelope in order to prevent these solvents from evaporating. Otherwise the ink would lose its viscosity and would no longer be capable of serving the purpose for which it is intended.

There was described in French patent No. 1,041,438 a ball-point pen for writing, the pen body being so designed as to contain an ink refill tube provided at the end remote from the ball with a rubber plug which can be perforated by means of a hollow needle screwed on the end of the pen body. This hollow needle establishes an air communication between the exterior and the refill, thus permitting the flow of ink.

This arrangement is not applicable to substances for marking or the like since they are relatively viscous and contain highly volatile solvents In fact, the above-mentioned communication established by means of the hollow needle causes evaporation of the solvents and does not permit pressurization for ensuring discharge of the substance through the application head.

In the majority of instances, fast-drying inks are used in markers of the type consisting of a completely air-tight flexible metal tube mounted on a marking head which permits a flow of ink as soon as its tip is placed in contact with the surface to be marked.

This marking head, which is fixed on the end of the flexible metal tube containing the ink, is constituted by a hollow cone usually of steel and containing a ball-valve. This valve includes a helical spring having the function of maintaining a ball against the valve-seat constituted by the circular discharge orifice of said metal cone so as to shut-off said orifice Said ball, the diameter of which is scarcely larger than that of said orifice, extends partly beyond the tip of the writing head formed by said metal cone.

In consequence, when said writing head is applied perpendicularly to the surface to be marked, the ball penetrates into its housing while compressing the spring which had maintained it against its seat, whereupon the ink is permitted to flow between the circular lips of the discharge orifice of the marking head.

However, in order to permit the flow of ink contained in an envelope which is tight against ingress of air, it is necessary to exert a pressure of the fingers on the external walls of the flexible metal tube which constitutes the marker body in order to compensate for he partial vacuum produced by the escaping ink.

Markers of this type with flexible metal walls have long been known and operate satisfactorily for the application of fast-drying inks.

However, they are subject to certain disadvantages: they are delicate in an industrial environment and are liable to burst readily, thus resulting in a loss of ink and in stains which are made even more disagreeable by the fact that these types of ink are usually indelible and water-resistant.

These markers are also awkward to handle since a clamping action of the fingers on the walls of the flexible tube has to be combined with the movement of the hand which is writing French patents No. 2,298,444 and 2,460,163 have provided a remedy for these drawbacks by making arrangements such that the flexible metal reservoir which contains the ink is enclosed within an air-tight casing supplied by a compressed air circuit, the object thereby achieved being to ensure that the pressure which is necessary for discharging ink to the marking head is exerted by the casing instead of the user's fingers on the flexible walls of said reservoir.

This supply of compressed air has the further advantage in accordance with French patent No. 2,460,163, by means of programmed pulses, of initiating at will the forward displacement of the marking head which is mounted on a piston with a restoring spring, with a view, for example, to placing said head in contact with a part to be marked which is presented on an assembly line. In this patent, however, consideration is given to a marking device which is intended to be employed in a stationary position since it has to be connected to a compressed air circuit.

In an alternative embodiment of French patent No. 2,298,444, provision is made for an autonomous manual marking device consisting of an ink refill with flexible walls enclosed within an air-tight cylindrical casing performing the function of a pen and supplied with compressed air by a hand-operated pump mounted on said casing at the end opposite to that of the marking head. The hand-pump makes it possible by means of a non-return valve to introduce into the air-tight cylindrical casing the compressed air which is intended to replace the pressure exerted by the user's fingers on the flexible walls of the tube containing the ink. However, in order to ensure good operation of a pen of this type, the pressure which has to be exerted on the flexible walls of the ink refill is relatively high (0.5 to 1 bar) and this calls for a relatively rugged and efficient manual pumping system. The pen in this case is a marking instrument which is excessively heavy to handle and inconvenient to use.

In order to discharge the ink to the marking head, a good solution therefore consists in producing action by means of a gas under pressure, not on the flexible walls of an ink refill, but directly on the ink itself. The necessary pressure is in that case extremely low in order to ensure good flow of the ink to the marking head and the pumping device can therefore be constituted by a very lightweight and economical assembly.

A device of this type for putting ink directly under pressure has been employed for the operation of certain industrial markers which have a rigid body containing a certain quantity of ink and which are intended to be discarded when empty. However, markers of this type are fairly expensive to manufacture with respect to the value of the ink which they contain.

SUMMARY OF THE INVENTION

The aim of the present invention is to produce a device for application of a substance, which is capable of receiving refills of a fast-drying substance, which prevents evaporation of the solvents contained in said substance, and which makes it possible to write easily on the entire surface.

The invention is thus directed to a device for applying a liquid or semi-paste substance on a surface, comprising a hermetically sealed refill containing said substance and removably disposed within a body which is intended to be manipulated by hand, said device being provided at one end with a head for application of said substance which is removably fixed at said end, means being provided for putting said application head into communication with the interior of the refill, said application head being provided with means for preventing discharge of the substance as long as said head is not applied on the surface, the other end of the body being provided with closure means.

In accordance with the invention, said device is distinguished by the fact that the refill is sealed-off at the end remote from the application head by a capsule of perforatable material and that the means for closing the body are adapted to carry a hollow needle which is capable of perforating said capsule when the refill is placed within said body, said hollow needle being adapted to communicate with air-pressurization means which can be actuated by hand and are carried by said closure means, said pressurization means being associated with means for closing the communication between the hollow needle and said pressurization means after release of these latter.

Air-tightness of the substance refill is thus guaranteed even after perforation of the capsule by the hollow needle.

The device is very easy to use since it is only necessary to actuate the pressurization means by hand in order to obtain good flow of the substance through the application head.

In an advantageous embodiment of the invention, the pressurization means comprise a thumb-actuated mini-pump associated with a non-return valve, the intended function of said mini-pump being to generate and maintain on the downstream side of said valve the air under pressure which is necessary for ensuring good flow of the substance.

In a preferred embodiment of the invention, the sealing capsule located at the rear end of the ink refill and intended to be pierced by the hollow needle for transmitting air under pressure is formed either wholly or partly of elastomer material which remains air-tight even after it has been pierced several times by said needle, thus enabling it to perform the function of a non-return valve.

BRIEF DESCRIPTION OF THE DRAWINGS

FIG. 3 is a fragmentary longitudinal sectional view of an alternative embodiment of the device.

FIG. 4 is a longitudinal sectional view of another alternative embodiment of the device.

DESCRIPTION OF THE PREFERRED EMBODIMENTS

The industrial pens illustrated in the accompanying drawings are intended to receive an ink refill of a particular type containing volatile solvents.

Figure 1:
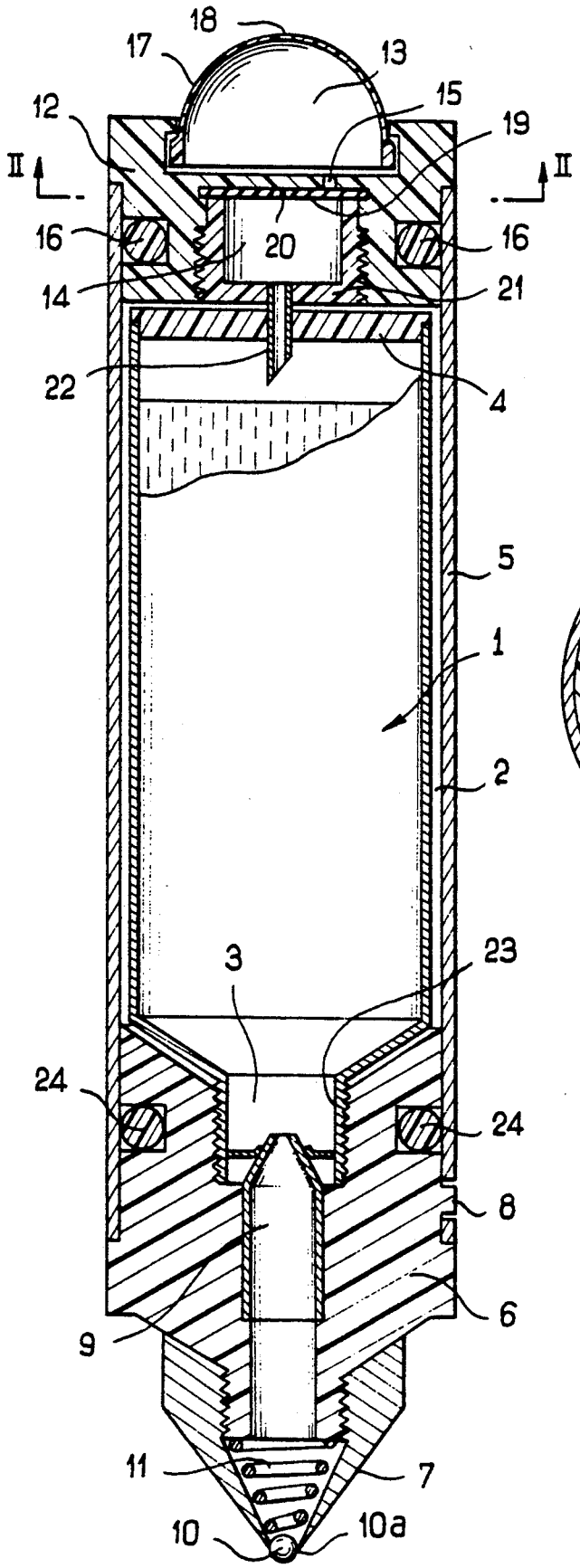
FIG. 1 is a longitudinal sectional view of a first embodiment of the application device in accordance with the invention in the form of an industrial marking pen.

In the embodiment of FIG. 1, the refill 1 which is intended to be discarded when empty is constituted by a lightweight but rigid metal tube 2 provided at the front end with a non-capped externally-threaded nipple 3 and at the rear end with a cylindrical plastic capsule 4 of small thickness which is intended to seal-off the refill after filling at works. This hermetically-sealed refill 1 is almost completely filled with ink so as to leave at the outset only a small volume of air imprisoned between the surface of the ink and the sealing capsule 4.

The industrial pen itself is composed of a central body 5 formed of a metal tube, the internal portion of which has a length and a diameter which are scarcely larger than those of the refill 1 in order to permit insertion of this latter, practically without any longitudinal or lateral play, once the pen has finally been reclosed.

In accordance with the present invention, said central body 5 is provided at its front end with a detachable sleeve 6 on which is mounted the writing head 7. The top circular rim of said sleeve 6 has an external diameter which corresponds to the internal diameter of the central pen body 5. Said sleeve is fixed on said body by force-fitting and is readily locked in this latter by engagement of a key 8 within a housing provided for this purpose.

Said sleeve 6 is pierced right through, from one end to the other. The inner end of the sleeve is intended to receive the threaded nipple 3 of the ink refill 1 and the outer end is intended to receive the writing head 7. At the inner end, said sleeve 6 is therefore provided with a screw-thread adapted to that of the nipple 3 of the ink refill 1 and also with a slightly conical hollow tube 9 which projects to the mid-height of the screw-threads aforesaid. Said hollow tube 9 acts as a plug and serves to pierce the nipple 3 of the refill 1 when this latter is screwed right home on the sleeve 6, thus having the effect of permitting downward flow of ink from the refill 1 into the writing head 7 which is screwed onto the outer end of the sleeve 6.

Said writing head 7 is constituted by a hollow cone of treated steel, the circular discharge orifice 10*a* of which is closed in leak-tight manner by a steel ball 10 having a diameter which is very slightly larger than said discharge orifice. Said ball 10 is held in position by a helical spring 11 but in such a manner as to ensure that part of the circumference of the ball 10 projects outwards from the orifice 10*a*.

The central body 5 of the industrial pen in accordance with the present invention is provided at its upper portion with a cylindrical closure end-cap 12 having an upper cavity 13 and a lower cavity 14 separated by a wall pierced with a small eccentric hole 15 having a diameter of approximately one millimeter. This end-cap 12 is force-fitted in leak-tight manner within the central body 5 by means of an O-ring seal 16.

On the upper cavity 13 of the end-cap 12 is fixed a hemispherical cap 17, the wall of which is formed of semi-rigid but elastic material such as neoprene, for example, which has a tendency to revert to its initial shape when pressure is exerted thereon. Said hemispherical cap 17 is pierced by a small axial hole 18 at the upper end thereof and can be actuated by the user's thumb so as to perform the function of an air mini-pump. The hole 18 is closed-off by the user's thumb at the time of pressurization of said mini-pump and permits ingress of air when pressure is no longer applied on the hemispherical cap 17, thus enabling this latter to revert to its initial shape.

Figure 2:
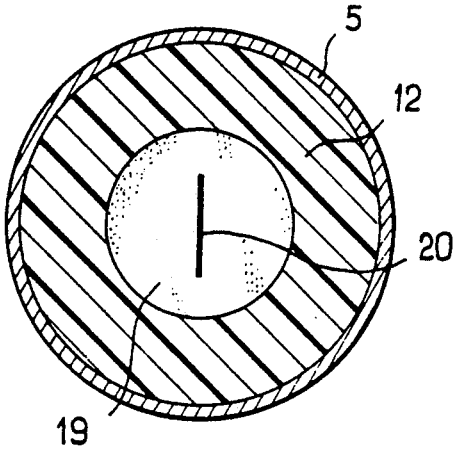
FIG. 2 is a sectional view taken along the plane II—II of FIG. 1.

By means of the small hole 15 which puts the upper cavity 13 into communication with the lower cavity 14 of the closure end-cap 12, said hemispherical cap is in communication with a non-return valve which allows air to pass only towards the interior of the pen. This valve is constituted by a resilient washer 19 of rubber, for example, which is applied against the wall provided with the hole 15. The center of said washer 19 has a small slit 20 (as shown in FIG. 2) which is displaced with respect to the hole 15 for the admission of air from the mini-pump 17.

The periphery of said washer 19 is maintained applied against the wall provided with the hole 15 by the circular lips of a hollow needle-holder 21 which is screwed into the lower cavity 14 of the end-cap 12.

As also shown in FIG. 1, a hollow needle 22 mounted on the hollow needle-holder 21 projects into the interior of the pen body 5 over a distance of a few millimeters. The function of said hollow needle 22 is to pierce the cylindrical capsule 4 which seals-off the rear end of the ink refill 1 when this latter is introduced into the pen body 5 and to put the interior of the ink refill into communication with the pressurization device constituted by the mini-pump 17 and the non-return valve 19.

The industrial pen which forms the subject of the present invention is used as follows:

The front sleeve 6 on which the writing head 7 is mounted is first of all removed from the central body 5 of the pen. The ink refill 1 is then fixed on the inner portion of said sleeve 6, the refill nipple 3 being screwed into the thread 23 provided for this purpose. During screwing, the hollow plug-tube 9 which projects to the mid-height of the threaded portion 23 bursts the end of said nipple 3, thus allowing the ink to gain access to the writing head 7.

The ink refill 1 to which the sleeve 6 for supporting the writing head 7 has thus been secured in leak-tight manner is then introduced into the central body 5 of the pen and said sleeve 6 is locked in position in the lower portion of said central body and in leak-tight manner by virtue of the presence of an O-ring seal 24. The locking operation is performed by introduction of a lug 8 in a recess formed in the edge of said central body. At the moment of locking, the ink refill 1 the length and diameter of which are practically identical with those of the interior of the central pen body 5 occupies the entire internal volume of this latter. Its plastic sealing capsule 4 located at its upper end has then encountered the hollow needle 22 which projects at the top end of the central pen body 5 and is attached to the hollow needle-holder 21 which is screwed into the lower cavity 14 of the closure end-cap 12. Said hollow needle 22 pierces said sealing capsule 4 and puts the interior of the ink refill 1 into communication with the air pressurization mechanism which is mounted on the closure end-cap 12.

When the pen has been reclosed, the user applies a pressure exerted by the thumb on the top of the resilient hemispherical cap 17 which is fixed within the upper cavity 13 of the pen closure end-cap, thus shutting-off the small hole 18 located at the top of said hemispherical cap 17. Deformation of said hemispherical cap 17 has the effect of a mini-pump which delivers air under pressure through the small eccentric hole 15 pierced through the wall which is located between the upper cavity 13 and the lower cavity 14 of the closure end-cap 12. The air under pressure which passes through said small hole 15 arrives in contact with the center of the resilient washer 19. Under the action of the air under pressure, the center of the plastic washer 19 is slightly deformed and the slit 20 located at the center half-opens so as to allow air to pass towards the hollow needle 22 and the ink refill 1.

When the mini-pump is no longer in operation, the air pressure which has been established downstream of the washer 19 has the effect of re-applying the center of said washer against the wall located between the two cavities 13, 14 of the closure end-cap 12, thereby re-closing the slit 20 through which air has passed. Since said slit 20 is in fact displaced with respect to the hole 15 through which air arrives from the mini-pump, the resilient washer then forms an air-tight barrier and performs the function of a non-return valve, the air under pressure located on the downstream side being no longer capable of flowing back in the opposite direction towards the mini-pump.

Said air under pressure is introduced, through the hollow needle 22 which has pierced its plastic sealing capsule 4, into the interior of the leak-tight ink refill 1 in which the volatile solvents also remain trapped on the downstream side of the non-return valve. Said air under pressure acts on the surface of the ink and has a tendency to expel said ink towards the writing head 7 through the nipple 3 of the refill 1 which was pierced by the plug-tube 9 when this latter was screwed onto the writing head of the pen.

When the writing head 7 is not being used, it is sealed-off by the ball-valve described earlier and the ink cannot flow. Furthermore, the volatile solvents cannot escape to the exterior.

On the other hand, as soon as the circular orifice **10*a* of the writing head 7 is applied perpendicularly to the surface to be marked, the ball 10 which serve as a valve withdraws into said orifice 10*a* while thrusting back the spring 11 which normally holds it against its seat. The ink which is subjected to the pressure of compressed air then flows between the lips of said orifice 10*a* as long as this latter is in contact with the surface to be marked and as long as the compressed-air pressure remains sufficient within the refill to ensure uniform flow. As soon as this pressure becomes insufficient, it can readily be restored during writing by applying pressure with the thumb on the mini-pump 17 which is located at the top of the pen closure end-cap 12**.

An alternative embodiment of the industrial pen i accordance with the present invention is illustrated in FIG. 3. The pen body 5 contains a very light-weight piston 25 which is in contact with the ink. Said piston is constituted by a cylinder having a resilient circular skirt adjusted to the internal diameter of the ink refill 1 but with sufficient tolerance to permit of free sliding displacement while making profitable use of the viscosity of the ink.

In this alternative embodiment, the compressed air does not act directly on the surface of the ink but by means of said piston 25. Since the viscous ink always remains downstream of the piston 25 even when the pen is placed upside down with respect to the vertical, it is accordingly possible in this alternative embodiment to write on the ceiling but the compressed air of the mini-pump is prevented from passing through the ink and escaping through the writing head 7 when its ball 10 is placed in contact with the surface to be marked.

In another alternative embodiment of the pen in accordance with the present invention as illustrated in FIG. 4, the sealing capsule 26 of the ink refill is formed of an elastomer which has the property of reverting to the air-tight state after it has been pierced by a needle even a number of times. Said sealing capsule 26 itself accordingly performs the function of a non-return valve.

In this embodiment of the invention, the closure end-cap 12 of the pen has only one upper cavity 27 in which is fixed the hemispherical pumping cap 17 of neoprene. A small bore 28 is located at the center of the circular wall which separates the cavity 27 from the central pen body 5. There can be slidably fitted within said bore 28 a hollow needle 29 which is intended to pierce the elastomer disk located at the center of the sealing capsule 26 of the ink refill 34.

In this embodiment of the present invention, the central pen body 5 which receives the ink refill 34 is of slightly greater length than said refill, with the result that the hollow needle 29 does not pierce the sealing capsule 26 as long as said needle is not displaced downwards. In fact, said hollow needle 29 is normally maintained in a position of withdrawal with respect to said capsule 26 by a cylindrical restoring spring 30.

A flattened circular head 32 is fixed at right angles to the axis of the hollow needle 29 at the top of this latter and immediately above an eye 31 which is intended for the flow of compressed air into said needle. Said needle head 32, the diameter of which is larger than that of the restoring spring 30, is located at the top end of said spring. The bottom end of said spring 30 is fixed on the periphery 33 of the bore 28 which is pierced at the base of the upper cavity 27 of the closure end-cap of the pen and through which the hollow needle 29 is already partially engaged whereas the tip of the needle has not yet pierced the sealing capsule 26 of the refill as long as the needle head 32 has not been downwardly displaced.

In this embodiment of the pen in accordance with the present invention, when action is produced on the hemispherical pumping cap 17 by the user's thumb, the effect thereby achieved is not only to generate a certain volume of air under pressure but also to apply pressure on the head 32 of the hollow needle 29, with the result that said head compresses the restoring spring 30 which had maintained the needle in the top position. Said hollow needle 29 which is thus displaced in the downward direction slides within the spring 30 and through the bore 28, said spring being fixed on the axis of said bore.

At the end of travel, the tip of the needle 29 pierces the center of the sealing capsule of elastomer 26 of the ink refill. Said hollow needle 29 then puts the interior of the hemispherical pumping cap 17 into communication with the interior of the ink refill 34 and the compressed air generated by deformation of said hemispherical cap is permitted to pass into said refill.

When the pressure exerted by means of the pumping cap 17 on the needle head 32 is released, the restoring spring 30 to which said head is attached causes upward displacement of the needle 29. The needle tip then withdraws from the elastomer disk 26. Since it has the property of reverting to the airtight state even after it has been pierced several times, said elastomer disk acts as a non-return valve. The compressed air introduced into the interior of the ink refill 34 can no longer escape towards the hemispherical pumping cap 17 and said compressed air exerts the desired pressure on the ink contained in the refill either directly or through a piston 25 in contact with the surface of the ink as shown in FIG. 3.

With respect to industrial markers of existing types, the industrial pen with ink refills in its different embodiments and in accordance with the present invention offers the following advantages:

Said industrial pen is more economical to use than the rigid industrial markers which also operate with a compressed-air mini-pump but which are discarded when empty. For an equivalent writing autonomy, the unit cost of each refill of this industrial pen is in addition considerably lower than the cost of said rigid markers and even lower than that of conventional markers having flexible metal walls.

Since the pen itself has a rigid metal body, it is designed as a workshop tool and is not delicate as in the case of industrial markers with flexible walls.

It is not necessary to exert pressure on the tube walls with the user's fingers in order to produce a flow of ink. Writing may accordingly be performed as with an ordinary pen, without any particular effort.

As will be readily apparent, the invention is not limited to the examples of construction described in the foregoing and any number of modifications may accordingly be contemplated without thereby departing either from the scope or the spirit of the invention.

What is claimed is:

1. A device for applying a liquid or semi-paste substance on a surface, comprising a hermetically sealed refill (1), containing said substrate and removably disposed within a body (5) which is intended to be manipulated by hand, said device having at one end a head (7) for application of said substance which is removably fixed at said end, means (9) for putting said application head (7) into communication with the interior of the refill (1), said application head having means (10, 11) for preventing discharge of the substance as long as said head is not applied on the surface, the other end of the body (5) having closure means (12), the refill (1) being sealed-off at its end remote from the application head (7) by a capsule (4) of perforatable material, said closure means (12) for the body (5) carrying a hollow needle (22) which is capable of perforating said capsule (4), said capsule (4) being made from a material such that a leak-tight sealing is provided when it is perforated by said needle when the refill is placed within said body (5), said hollow needle (22) communicating with air pressurization mans (17) which can be actuated by hand and which is carried by said closure means (12), means (19, 20) for closing the communication between the hollow needle (22) and said pressurization means after release of said pressurization means, said pressurization means comprising a manually-actuated mini-pump (17) having a non-return valve (19), said mini-pump generating and maintaining on the downstream side of said valve (19) air under pressure to ensure good flow of the substance, there being a cavity (14) between the non-return valve (19) and the hollow needle (22), said non-return valve (19) being constituted by a resilient washer having a small slit and a periphery, said cavity (14) having a bottom provided with a hole (15) communicating with said mini-pump (17), said washer being applied against said bottom, said hollow needle (22) being mounted in a hollow needle-holder (21) which is screwed into said cavity (14), said hollow needle-holder (21) having a circular end lip applied against the periphery of said washer.

2. A device according to claim 1, wherein the application head (7) has a ball-valve (10 and 11) which permits the flow of ink only when the tip (10) of said writing head (7) is applied perpendicularly to the surface to be marked.

3. A device according to claim 1, wherein a sealing capsule (26) located at the rear end of an ink refill (34) and adapted to be pierced by the hollow needle (22) for transmitting air under pressure, is formed either wholly or partly of elastomeric material which remains air-tight even after it has been pierced several times by said needle (29), thus enabling said sealing capsule (26) to perform the function of a non-return valve.

4. A device according to claim 1, wherein the mini-pump (17) is constituted by a resilient-walled chamber in the form of a hemispherical cap provided with a hole (180 for the flow of air which is adapted to be shut-off by the user's digit at the moment of pressurization.

5. A device according to claim 1, wherein the refill (1) has a volume substantially equal to the internal volume of the body (5) so that the hollow needle (22) automatically pierces the capsule (4) of the refill (1) when said refill is inserted in said body.

6. A device according to claim 1, wherein the hermetically sealed refill has a cylindrical piston (25) of low-density material which is capable of sliding in said refill and is in contact with the surface of the substance, said piston being intended to receive on the face remote from the substance the pressure of compressed air generated by the pressurization means and to transmit said air pressure to the entire volume of substance contained in the refill irrespective of the position of the device with respect to the vertical.

7. A device according to claim 1, wherein said sealing capsule (4) of said hermetically sealed refill (1) is formed either wholly or partly of transparent material.

* * * * *